United States Patent [19]

Huemer

[11] Patent Number: 4,616,681

[45] Date of Patent: Oct. 14, 1986

[54] ARRANGEMENT FOR THE SUPERVISION OF WEFT THREADS ON A CIRCULAR LOOM

[76] Inventor: Franz X. Huemer, Sonnenuhrgasse 4, 1060 Vienna, Austria

[21] Appl. No.: 736,792

[22] Filed: May 22, 1985

[30] Foreign Application Priority Data

Jun. 8, 1984 [CH] Switzerland ..... 2798/84

[51] Int. Cl.[4] ..... D03D 37/00; D03D 51/34

[52] U.S. Cl. ..... 139/371; 139/13 R

[58] Field of Search ..... 139/370.1, 13 R, 13 A, 139/16, 371

[56] References Cited

U.S. PATENT DOCUMENTS

| | | | |
|---|---|---|---|
| 2,088,045 | 7/1937 | Werner | 139/371 |
| 2,433,479 | 12/1947 | Pelcé | 139/13 R |
| 2,512,428 | 6/1950 | Hutchins | 139/371 |
| 3,467,149 | 9/1969 | Dosch | 139/371 |

FOREIGN PATENT DOCUMENTS

| | | | |
|---|---|---|---|
| 1538492 | 6/1967 | France | 139/371 |
| 2012138 | 2/1968 | France | 139/371 |

*Primary Examiner*—Henry S. Jaudon

*Attorney, Agent, or Firm*—Karl F. Ross; Herbert Dubno

[57] ABSTRACT

Weft threads on a circular loom which are wound off the respective bobbin of the weaving shuttle traveling in the weaving shed along a circular path formed by the circular reed, and transferred onto the fabric edge of the tubular fabric, are supervised by a scanner in order to generate an electric stop signal in the case of a weft thread fault. This results from the use of a non-contact sensory system of capacitive, inductive, opto-electric or magnetic kind, with the scanner means comprising a tipping lever supported on the respective shuttle and acted upon by the drawn-off thread against the effect of a restoring force, said tipping lever functioning like a switch, in the case of a weft thread fault, and combined with at least one signal transmitting component of the sensory system arranged on the reed. This permits the correct supervision of the existance of the weft threads wound off the bobbins of the circulating shuttles in order to stop the loom immediately, so as to avoid a weaving fault, in the case of a weft thread failure owing to weft thread breakage or depletion of the weft thread package, for example.

10 Claims, 3 Drawing Figures

ARRANGEMENT FOR THE SUPERVISION OF WEFT THREADS ON A CIRCULAR LOOM

FIELD OF THE INVENTION

The present invention relates to an arrangement for the supervision of weft threads on a circular loom in which the weft threads are wound off the respective bobbin of the weaving shuttle traveling in the weaving shed along a circular path formed by the circular reed, and transferred onto the fabric edge of the manufactured tubular fabric, by scanner means supervising the respective weft thread in order to generate an electric stop signal in the case of a weft thread failure.

BACKGROUND OF THE INVENTION

Hitherto known circular looms comprise a plurality of partial heald shafts, which are arranged circularly around the circular reed of the loom, and each has a plurality of inner and outer healds for the guidance of a part of the two systems of warp yarn distributed all around the arrays of healds, which, for the formation of the weaving shed or travelling shed, are given by the main shaft, an opposing up-and-down alternating motion. The weaving shuttles circulated in the circular reed by the main shaft carry the weft threads which are unwound from the respective bobbins carried by the shuttles continuously into the travelling shed. The tubular fabric thus manufactured is then drawn off and spread as a flat tubular fabric.

It is essential that the weft threads wound off the circulating shuttles be meticulously supervised in order to switch off the loom immediately, so as to avoid weaving faults, in the case of a weft thread failure, owing to weft thread breakage or depletion of the weft thread package, for example.

Hitherto-known arrangements of this kind employ for this purpose photo-visual signal transmitters or work with loop contact. Light barrier means as well as loop contacts are unable to satisfy today's requirements, in particular with regard to the substantial increase in the rotational speed of the weaving shuttles. Light barrier means have, moreover, always been susceptible to the effect of outside light, quickly become dusty and do not permit the manufacture of reflex bands or tapes owing to their becoming "blind". Loop contact means are, on the other hand, of only very limited use on today's high-performance looms.

OBJECT OF THE INVENTION

It is therefore the object of the present invention to provide an arrangement for the supervision of weft threads on a circular loom, without the inherent disadvantages previously noted.

SUMMARY OF THE INVENTION

According to invention, this is achieved by generating the stop signal a non-contact sensory system of capacitive, inductive, opto-electric or magnetic kind, which is capable of being activated by the scanner means, with the scanner means comprising a tipping lever supported on the respective shuttle and acted upon by the drawn-off thread against the effect of a restoring force, said tipping lever functioning like a switch, in the case of a weft thread fault, and combined with at least one signal transmitting component of the sensory system arranged on the reed.

Such an arrangement is neither subject to the effect of outside light nor troubled by dust or any other wear. This arrangement permits, moreover, also the manufacture of reflex bands or tapes, functions safely at all rotational speeds and possesses very high acoustic sensitivity and speed.

For a safe activating stress of the tipping lever by the wandering weft thread when winding off over the whole width of the bobbin, the invention forms the tipping lever comprises a rod, extending parallel to the shuttle bobbin, the weft being at least partially wound around the rod on leaving the bobbin. Advantageously arms extend from the rod on both ends and laterally of the shuttle bobbin and are swingable in supporting pivots on the shuttle, with a switch arm extending from the tipping lever towards the reed. The restoring force acting upon the tipping lever is generated by spring means or by torsional stress or by the weight of the tipping lever itself.

Further, a very simple conception of the object of invention is then achieved when the tipping lever is at least partially composed of a steel wire.

BRIEF DESCRIPTION OF THE DRAWING

Embodiments of the present invention will now be more particularly described by way of example and with reference to the accompanying drawing, in which.

SPECIFIC DESCRIPTION

Figure 1:
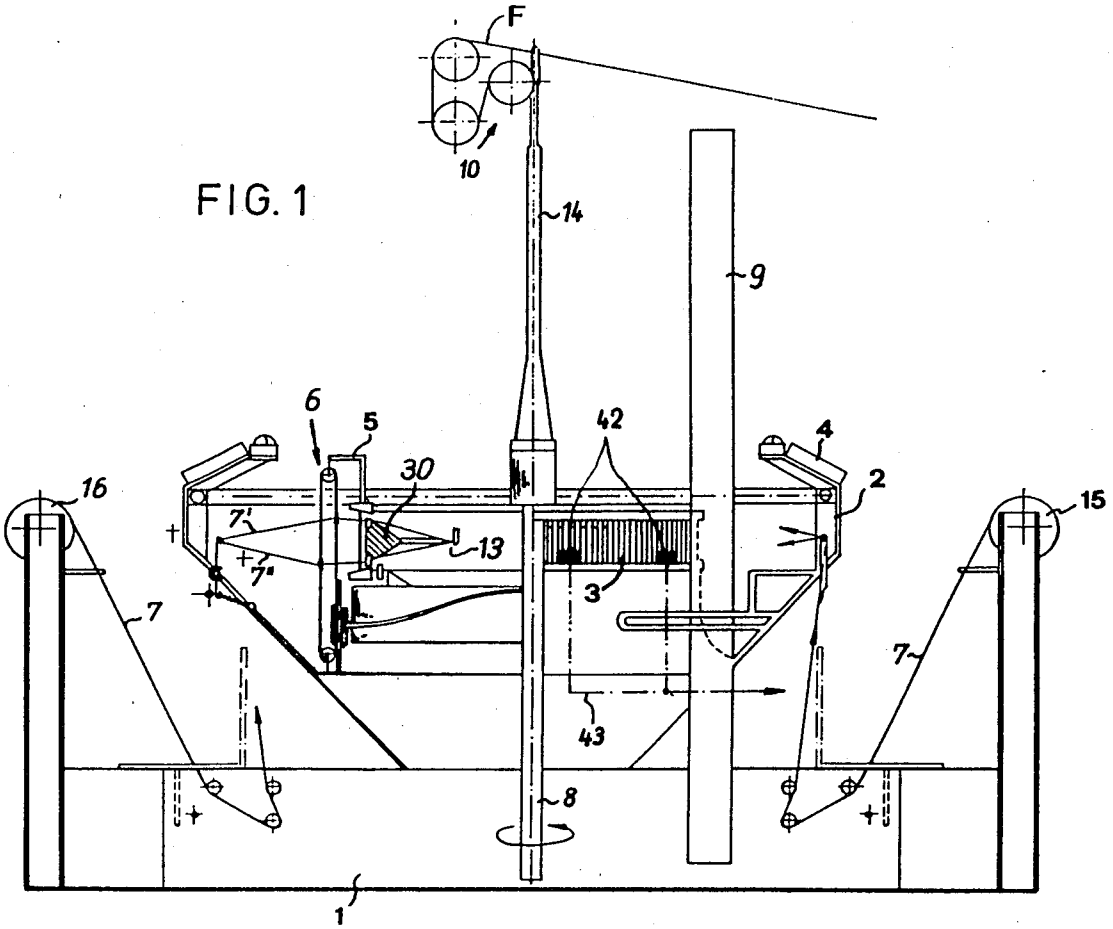
FIG. 1 highly schematic side elevation of a circular loom.

The circular loom according to FIG. 1 rests, as is known per se on a loom base 1, which supports a circular frame carrier 2, carrying a circular reed 3, an on/off switch 4 for the loom, and further frame members 5 for the support of heald shafts 6. These shafts 6 are also in a generally known manner, arranged in a circle around the main shaft 8 of the loom, and, in the main, constitute the shed-forming means of the machine. Furthermore, the support 9 for the cloth draw-off mechanism is supported on the loom base 1, which is here indicated only by the cloth draw-off rollers 10. A fabric spreader 14 is also disposed in the draw-off area. Further, in the circular loom illustrated, it is also possible to see the draw-in roller 15 for the warp threads on the left-hand side, and the draw-in roller 16 for the warp threads on the right-hand side. These warp threads 7, the course of which is only partly indicated, are divided into two circumferentially disposed warp thread gatherings and are drawn in the known manner from groups of warp thread spools, which are not illustrated more closely here. For the formation of the weaving shed, one of these thread gatherings is lifted up while the other is guided down from the level of the weaving plane through the so-called change of shed motion, so that a warp top shed 7' and a warp lower shed 7'' result. In this so-called weaving or multiphase shed, at least one shuttle 30, but as a rule several shuttles, each with a weft yarn bobbin 31 (FIG. 2) travel around a horizontal path. Owing to the circular motion of the shuttles, the weft yarn 32 wound off the weft yarn bobbins is transferred onto the edge 13 of the tubular fabric which can be seen only after it has been spread out at F. The tubular fabric can then be drawn off and laid together as a flat tubular fabric.

To the extent described above, the construction of the circular loom corresponds to that of the prior art, so that further explanation of such a loom is unnecessary.

The weft threads 32 wound off the bobbins 31 of the circulating shuttles 30 must be meticulously and functionally reliably supervised, in order to stop the loom immediately, in the case of a weft thread failure, by means of a generated stop signal to which is delivered by line 43 to the machine contoller.

For this purpose, it is intended to have the stop signal 43 generated by a non-contact sensory system 40 of capacitive, inductive, opto-electric or magnetic kind, which is capable of being activated by scanner means, with the scanner means comprising a tipping lever 41 supported on the respective shuttle 30 and acted upon by the drawn-off thread against the effect of a restoring force, the tipping lever functioning like a switch, in the case of a weft fault, and combined with at least one signal generating component 42 of the sensory system arranged on the reed 3.

In order to reduce the circular path of the shuttle concerned down to only a few degrees of angle between the occurrence of a weft failure and the activation of the signal transmitting component, it is of advantage to arrange a plurality of such signal transmitting components 42 in circumferentially spaced relation on the reed 3, as shown in FIG. 1.

Figure 2:
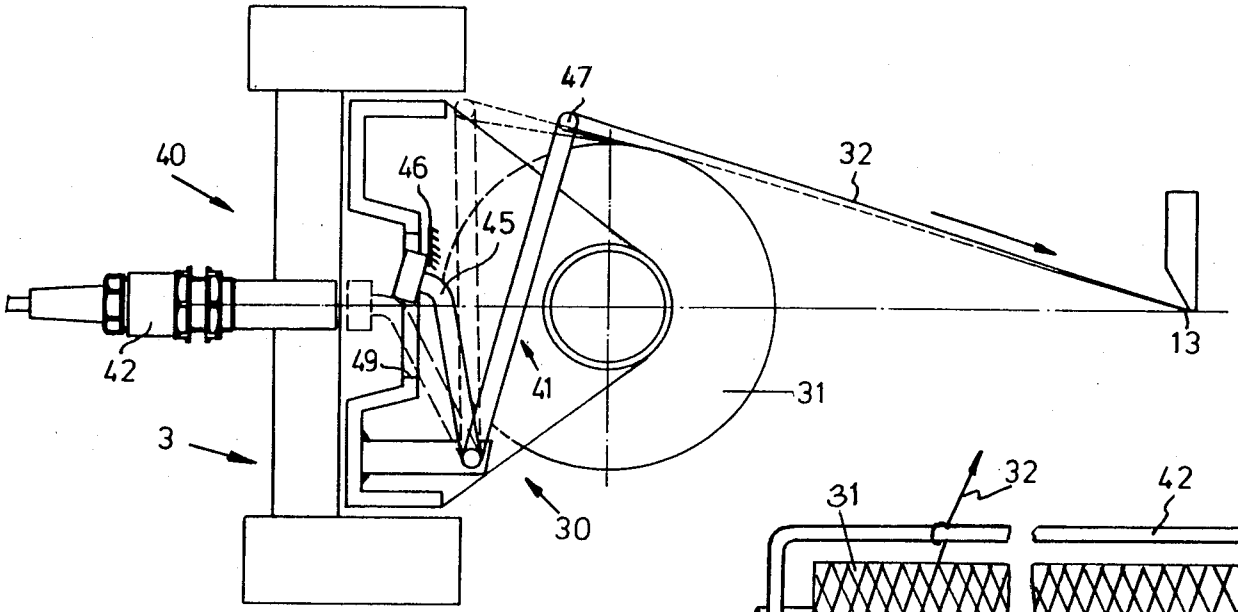
FIG. 2 is a schematic representation in side view of the arrangement for the supervision of weft threads according to invention and to FIG. 1, on a larger scale.
Figure 3:
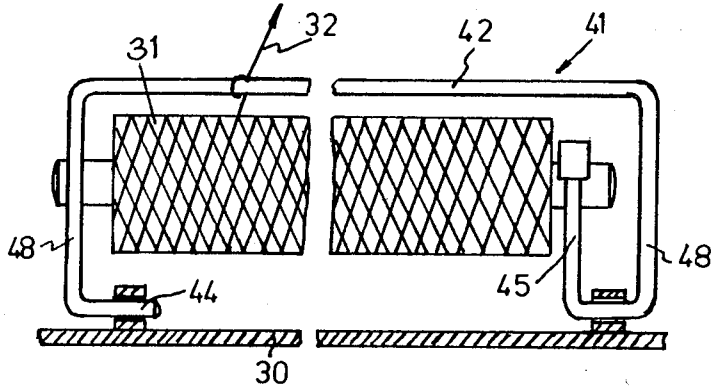
FIG. 3 is a detail of the arrangement according to FIG. 2, in front view and on a larger scale.

As is shown in more detail in FIGS. 2 and 3, the tipping lever 41 comprises a rod 47, extending parallel with the shuttle bobbin 31, said ruler being at least partially wound around by the paid-off weft thread 32.

In this connection, arms 48 extend from the ruler 42 on both ends of and sideways from the shuttle bobbin 31, which engage supporting pivots 44 on the shuttle 30, with one of the arms 48 carrying a switch arm 45 extending from the tipping lever 41 towards the reed 3 to cooperate with and activate the signal generators 42.

Depending on the specific embodiment of the tippng lever 41 and the support thereof, which, of course, may be optional, the restoring force, acting upon the tipping lever 41, is generated by spring means or by tensional stress, or by the weight of the tipping lever itself.

Furthermore, it is of advantage for the tipping lever 41 to be made up of a steel wire, whereby the rod 47 can have a porcelain casing (not illustrated) for a gentle, protective thread guidance.

The very simple method of operation of the arrangement according to invention may be seen in particular in FIG. 2. Accordingly, the weft thread 32 wound around the rod 47 and winding off the bobbin 31 towards the fabric edge 13, tips the tipping lever 41 clockwise against a stop 46 on the weaving shuttle 30. Therewith, the switch arm 45 of the tipping lever 41 remains during its traversing with the shuttle outside the radius of action with the signal transmitting component 42 or the signal transmitting components 42 of the sensory system 40. In the case of weft thread 32 breakage, however, the tipping lever 41 falls counterclockwise (FIG. 2), under the effect of its prestressing, towards the reed 3 to a stop 49, in which, in FIG. 2 the contact position of the shift arm 45 is drawn in dotted lines, this activates the next signal transmitting component 42 when traversing, with the latter supplying the stop signal 43 for the loom.

Thus, from the foregoing, there results an arrangement for the supervision of weft threads on a circular loom, which meets all previously-mentioned requirements. In particular, the previously-described measures show how an easy change-over and adaption of existing looms is possible, as well as the utilization of the weft thread supervision arrangement on other thread-processing machines.

Here, of course, various modifications are possible within the framework of the present invention. Thus, for example, the tipping lever 41 can be situated at another place, for example supported orientable in the rotational center of the weft thread bobbin 31. For an opto-electric scanning, the tipping lever can, moreover, carry one part of the light barrier, with this part coming, at the breaking of a thread, out of the area of a screening shield on the shuttle into the radius of effect of the other part of the light barrier on the reed 3, whereby a signal is generated.

While there are shown and described present preferred embodiments of the invention, it is to be distinctly understood that the invention is not limited thereto, but may be otherwise variously embodied and practiced within the scope of the following claims.

What I claim is:

1. In a circular weaving machine having a circular reed in which a traveling shed is formed by warp threads to produce a tubular fabric along an edge of said shed by weft thread paid-off from a bobbin of a shuttle traveling in a circular path in said reed and said shed, the improvement which comprises a weft thread monitoring device comprising:

a tipping lever pivotally mounted on said shuttle and comprising a rod extending parallel to said bobbin and over which the weft thread from said bobbin is paid-out after being at least partially wound about said rod, respective support arms connected to each end of said rod and pivotally mounting said lever on said shuttle, and an actuating arm connected to one of said support arms for swinging movement with said lever toward said reed upon relaxation of a force applied to said rod by said warp thread as it is paid-out from said bobbin into said shed to form said fabric at said edge;

means for generating a restoring force on said tipping lever biasing same in a direction tending to swing said actuating arm toward said reed; and at least one signal generator disposed along said reed and responsive to the passage of said shuttle when said actuating arm has been swung toward said reed in contactless manner for generating a stop signal to terminate operation of the loom and prevent weft threads faults from being produced in said fabric upon a weft thread failure.

2. The improvement defined in claim 1 wherein a plurality of signal-generator units responsive to said actuating arm are provided in circumferentially spaced relation along said reed and each is adapted to output a loom stopping signal.

3. The improvement defined in claim 1 wherein said means generating said restoring force is a spring acting on said tipping lever.

4. The improvement defined in claim 1 wherein said means for generating said restoring force includes means applying a tortional stress to said tipping lever.

5. The improvement defined in claim 1 wherein said means for generating said restoring force is constituted by the weight of the tipping lever.

6. The improvement defined in claim 1 wherein said actuating arm and said signal-generating means form a capacitative contactless sensory system.

7. The improvement defined in claim 1 wherein said actuating arm and said signal-generating means form an inductive contactless sensory system.

8. The improvement defined in claim 1 wherein said actuating arm and said signal-generating means form a magnetic contactless sensory system.

9. The improvement defined in claim 1 wherein said actuating arm and said signal-generating means form an optoelectric contactless sensory system.

10. The improvement defined in claim 1 wherein said tipping lever is composed of a steel wire.

* * * * *